US005083324A

United States Patent [19]

Strong

[11] Patent Number: 5,083,324

[45] Date of Patent: Jan. 28, 1992

[54] PORTABLE COLLAPSIBLE TOILET SEAT

[76] Inventor: Eric A. Strong, 2604 Persimmon Dr., Starkville, Miss. 39759

[21] Appl. No.: 662,440

[22] Filed: Feb. 28, 1991

[51] Int. Cl.[5] ..... A47K 11/02

[52] U.S. Cl. ..... 4/460; 182/187

[58] Field of Search ..... 4/449, 479–484, 4/460; 182/187

[56] References Cited

U.S. PATENT DOCUMENTS

| | | | |
|---|---|---|---|
| 1,306,041 | 6/1919 | Wittmann | 4/460 |
| 2,711,783 | 6/1955 | Prill | 182/187 X |
| 3,067,975 | 12/1962 | Wilcox | 182/187 X |
| 3,513,940 | 5/1970 | Ussery | 182/187 |
| 4,601,364 | 7/1986 | York | 182/187 |
| 4,705,143 | 11/1987 | Ziemba | 182/187 |
| 4,909,353 | 3/1990 | Govin et al. . | |

FOREIGN PATENT DOCUMENTS

| | | | |
|---|---|---|---|
| 588561 | 2/1959 | Italy | 4/449 |

*Primary Examiner*—Charles E. Phillips

[57] ABSTRACT

A portable toilet seat usable in a wilderness environment where there is no plumbing system available for operatively connecting a conventional toilet. The toilet seat includes a seat member having a clamp means at its rear edge for rigidly attaching the seat member to the trunk of a tree in a wilderness setting. A foldable leg structure is swingably attached to the front edge area of the seat member for supporting the front portion of the seat member. The leg structure can be folded against the seat member for storage or transport purposes.

5 Claims, 1 Drawing Sheet

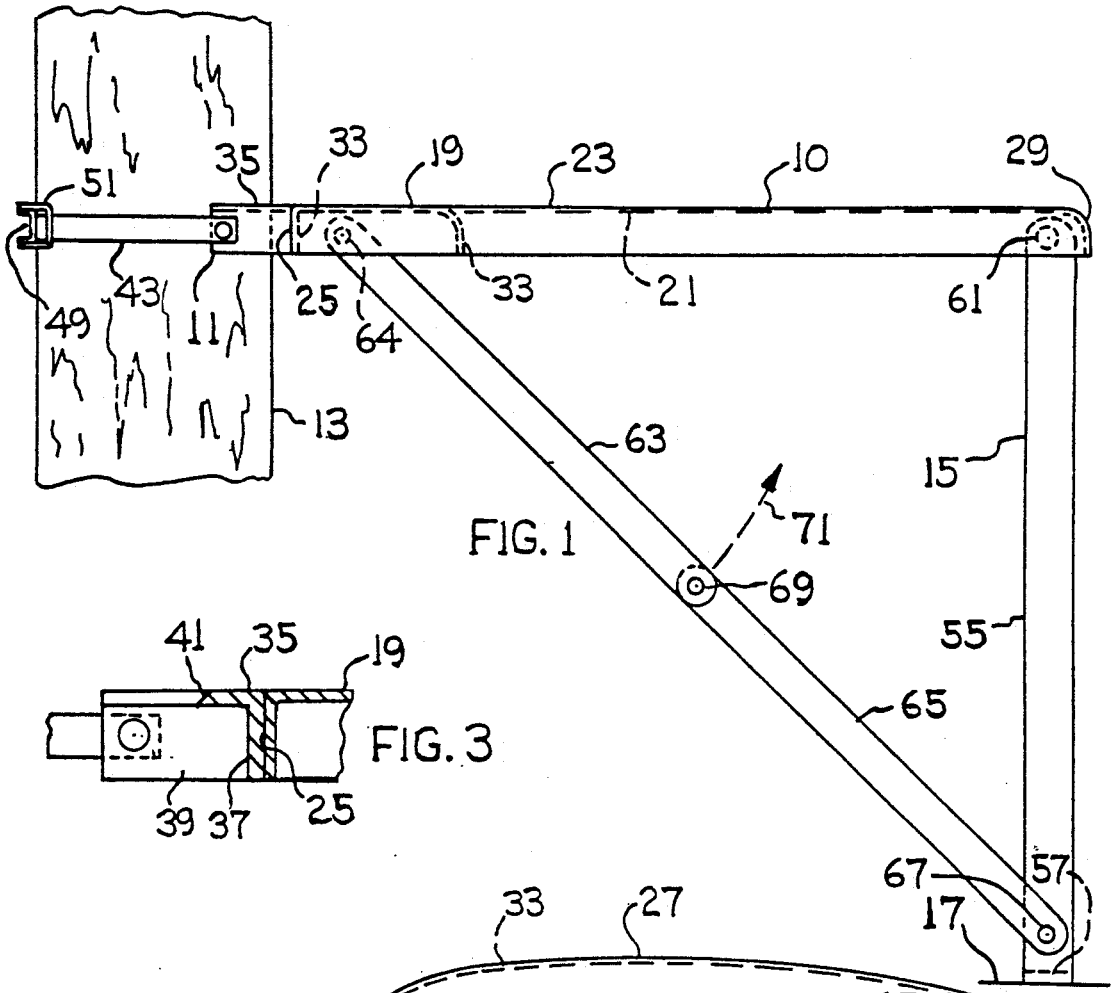
FIG. 1
FIG. 3
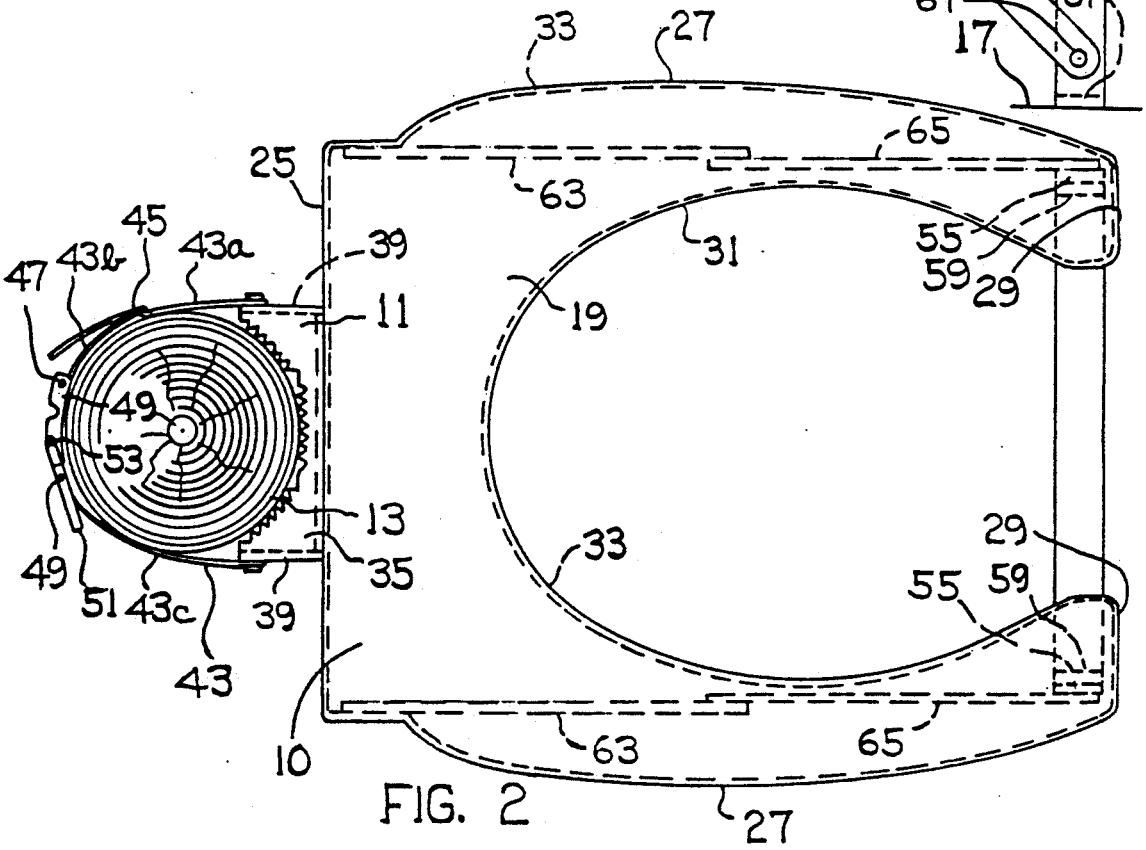
FIG. 2

PORTABLE COLLAPSIBLE TOILET SEAT

BACKGROUND AND SUMMARY OF THE INVENTION

This invention relates to a portable toilet structure usable by campers and outdoorpersons in wilderness areas where there are no plumbing facilities that can be used to operatively connect a conventional toilet. The invention is in some respects an improvement on a toilet seat shown in U.S. Pat. No. 1,306,041 issued to J. Wittmann.

U.S. Pat. No. 1,306,041 shows a portable toilet that includes a flat horizontal seat member having a hinged connection to a downwardly extending leg board. A seat support bar extends along the undersurface of the seat member and through a slot in the upper edge of the vertical leg board. The support bar extends beyond the edge of the seat member, whereby the outer end of the bar can be attached to the trunk of a tree (in a wilderness environment). A flexible tie member is wrapped around the tree trunk to anchor the seat member support bar to the tree.

The present invention contemplates a portable toilet seat wherein the seat member is directly connected to the trunk of a tree by a clamp mechanism carried at the rear edge of the seat member. The clamp mechanism comprises a clamping plate and a flexible strap means. A manually-operated tensioner means can be incorporated into the strap means so that when the strap means is tightened on the tree trunk a serrated edge on the clamping plate digs into the tree bark to support the rear edge of the seat member. A foldable leg structure is pivotably connected to the undersurface of the seat member at its front edge, so that the seat member is supported at two points, i.e. near its rear edge and also near its front edge. The leg structure can be folded against the undersurface of the seat member for compact storage or transport.

THE DRAWINGS

FIG. 1 is a side elevational view of a toilet seat structure embodying this invention.

FIG. 2 is a top plan view of the FIG. 1 structure.

FIG. 3 is a fragmentary sectional view taken through a structural detail used in the FIG. 1 device.

DESCRIPTION OF A PREFERRED EMBODIMENT OF THE INVENTION

The drawings show a portable toilet seat for use in wilderness areas. The seat structure comprises a horizontal seat member 10, and a clamp means 11 extending from the rear edge of seat member 10 for encirclement of a tree trunk 13, whereby the seat member 10 is partially supported by the tree. A foldable leg structure 15 is attached to the front edge of seat member 10 for supporting the front portion of the seat member above ground surface 17 (FIG. 1). The toilet seat member is thus supported at two points, i.e. at its rear edge via the tree trunk, and at its front edge via leg structure 15. The leg structure is foldable against the undersurface of seat member 10 for compact storage or transport.

Seat member 10 is a metal stamping, preferably aluminum for lightness. The seat member includes a main wall 19 having an undersurface 21 and an upper surface 23. Wall 19 has a rear edge 25, two outer side edges 27, two front edges 29, and an inner arcuate edge 31. As seen in FIG. 1, wall 19 has a U-shaped plan outline.

Wall 19 could, in the alternative, have an annular oval configuration, as by the addition of a transverse wall section along its front portion.

Seat member 10 is reinforced against bending or deformation by means of a downwardly-extending continuous flange 33 extending along the seat member edges, i.e. rear edge 25, outer side edges 27, front edge 29, and inner arcuate edge 19. The continuous reinforcement flange enables the seat member to be formed as a light weight aluminum stamping, using a relatively light gage sheet of aluminum.

Clamp means 11 comprises a steel plate 35 having a flange 37 for its attachment to the rear edge of seat member 10. The rear edge of plate 35 is concave, as viewed in FIG. 2, whereby the plate rear edge is enable to conform to the curved contour of tree trunk 13. Also, the plate rear edge is serrated to form a series of sharp spikes having the ability to penetrate the bark of the tree trunk for holding the plate at a desired level above the ground surface. As best seen in FIG. 3, the upper surface of the plate serrated edge is bevelled (sharpened), as at 41, to further sharpen the apex areas of the serrations.

Flexible straps 43 are attached to fange areas 39 of steel plate 35. One of the straps includes a buckle structure 45 for taking up slack when the strap assembly is trained around a tree trunk; the buckle structure also permits sections of the strap means to be separated for placement around the tree. Holes are formed in section **43*a* of the strap means for taking up slack. Strap section 43*b* is attached at 47 to a manually-operated strap tensioner element 49. Strap section 43*c* has one end thereof attached to steel plate flange 39 and its other end attached to a pin 49 that forms part of a lever 51. The lever has a pivotal connection 53 with tensioner element 49**.

To connect seat member 10 to the tree trunk the straps are unbuckled and trained around the tree trunk surface; buckle structure 45 is then tightened as far as possible to have the strap means fit snugly around the tree. Lever 51 is then moved clockwise around pivot-connection 53 (FIG. 3) to place the strap sections **43*a*, 43*b* and 43*c* in tension. The tension force causes the serrated edge on steel plate 35 to dig or bite into the tree bark, thereby anchoring seat member 10** to the tree trunk.

Leg structure 15 is formed out of a steel bar bent into a U configuration. The bar comprises two elongated support bars 55 and a transverse foot bar 57. Each bar 55 has a pivotal (swingable) connection 61 to seat member 10; lugs 59 extend from the undersurface of member 10 alongside upper end sections of bars 55 to mount pivot pins 61.

As shown in FIG. 1, the U-shaped leg structure extends downwardly from seat member 10 so that transverse bar 57 rests on the ground surface 17. The leg structure thus provides a support action for the front portion of the toilet seat. The U-shaped leg structure may be swung around the axis of pivot pins 61 to collapsed storage positions extending alongside the undersurface of member 10. The U-shaped leg structure is sized so as to be foldable into the plane of member 10, i.e. within the space circumscribed by peripheral flange 33.

A foldable brace means is associated with each bar 55 to prevent inadvertant buckling or collapse of the leg structure when it is in its extended support position (FIG. 1). Each brace means comprise an upper brace bar 63 having a pivotal connection 64 with flange 33 of seat member 10, and a lower brace bar 65 having a pivotal connection 67 with one of bars 55. The two brace bars 63 and 65 are pivotably joined by means of a pivot connection 69. The brace construction can be folded into the plane of seat member 10, to thereby pull the U-shaped leg structure into its collapsed storage position. Numeral 71 indicates the motion of pivot connection 69 that takes place when the brace structure and leg structure are moved to their collapsed positions.

The illustrated toilet seat construction is a relatively low cost, high strength structure that will provide a rigid stable support for the person in a wilderness environment. The seat construction provides a relatively small flat package in its collapsed condition.

What is claimed is:

1. A portable toilet seat for use in wilderness areas, comprising a toilet seat member having an undersurface, and an upper surface adapted to engage a human body in a seated position, said upper surface having a rear edge, two outer side edges extending from the rear edge, a front edge, and an inner arcuate edge extending within the space circumscribed by the rear edge and two outer side edges; a tree clamp mean extending from the rear edge of the toilet seat member; and a foldable leg structure having pivotable connections to the undersurface of said seat member; said tree clamp means comprising a flexible strap means having opposite ends thereof anchored to the seat member at laterally spaced points; said flexible strap means having a buckle structure for separating the strap means so that the strap means can be extended around a tree trunk; said flexible strap means having a manually-operated tensioner means for causing the strap means to grip the tree surface so as to support the rear portion of the toilet seat member above the ground surface; said leg structure comprising a U-shaped member that includes two elongated parallel support bars pivotably connected to the seat member at laterally spaced points near the seat member front edge, and a transverse foot bar extending between said parallel bars, said U-shaped member being swingable between a collapsed position extending along the undersurface of the seat member, and a support position extending downwardly from the seat member.

2. The toilet seat of claim 1, wherein said seat member has a peripheral flange extending downwardly from its upper surface, said peripheral flange being a continuous flange extending along the seat member rear edge, outer side edges, front edge and inner edge; said leg structure being pivotably connected to the undersurface of the seat member so as to be foldable into the space circumscribed by said peripheral flange.

3. The toilet seat of claim 2, wherein said seat member is a metal stamping.

4. The toilet seat of claim 2, wherein said foldable leg structure further comprises a foldable brace means trained between the toilet seat member and each one of said parallel bars; each brace means comprising a first brace bar swingable connected to the seat member near its rear edge, a second brace bar swingably connected to one of the parallel bars at a point near the transverse foot bar, and a pivotable connection between the first brace bar and second brace bar; each said brace means having a folded position extending along the undersurface of the seat member, and an operating position extending forwardly and downwardly at an acute angle to the parallel bars.

5. The toilet seat of claim 2, wherein said tree clamp means comprises a steel plate extending rearwardly from the rear edge of the toilet seat member, said plate having a serrated rear edge adapted to engage a tree surface so that when the strap means is tensioned the plate serrated edge will dig into the tree surface.

* * * * *